US006482791B2

(12) United States Patent
Sano et al.

(10) Patent No.: US 6,482,791 B2
(45) Date of Patent: Nov. 19, 2002

(54) LIQUID BLEACH CLEANER COMPOSITION COMPRISING HYPOCHLOROUS ACID

(75) Inventors: Yutaka Sano, Wakayama (JP); Hiroyuki Yamada, Tokyo (JP); Kazunori Tsukuda, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/059,253

(22) Filed: Jan. 31, 2002

(65) Prior Publication Data

US 2002/0151455 A1 Oct. 17, 2002

(30) Foreign Application Priority Data

Feb. 15, 2001 (JP) ..... 2001-038136

(51) Int. Cl.[7] ..... C11D 3/395; C11D 1/62

(52) U.S. Cl. ..... 510/380; 510/238; 510/302; 510/319; 510/382; 510/367; 510/379; 510/384; 510/391; 510/503; 510/504; 510/518

(58) Field of Search ..... 510/238, 302, 510/319, 382, 367, 379, 380, 384, 391, 503, 504, 518

(56) References Cited

U.S. PATENT DOCUMENTS 5,814,591 A * 9/1998 Mills et al. ..... 510/238
5,948,741 A * 9/1999 Ochomogo et al. ..... 510/191
5,962,391 A * 10/1999 Oldenhove ..... 510/369
6,245,361 B1 * 6/2001 Merritt ..... 424/665

FOREIGN PATENT DOCUMENTS

| | | | |
|---|---|---|---|
| JP | 56-90897 | | 7/1981 |
| JP | 57-61099 | | 4/1982 |
| JP | 63-72798 | | 4/1988 |
| JP | 63-165495 | | 7/1988 |
| JP | 1-153797 | | 6/1989 |
| JP | 7-82593 | | 3/1995 |
| JP | 7-082593 | * | 3/1995 |
| JP | 10-204495 | | 8/1998 |
| JP | 192700 | * | 7/2001 |
| JP | 2001-192700 | | 7/2001 |

* cited by examiner

*Primary Examiner*—Charles Boyer
(74) *Attorney, Agent, or Firm*—Oblon, Spivak, McClelland, Maier & Neustadt, P.C.

(57) ABSTRACT

The present invention provides a bleach cleaner composition which exhibits excellent bleach cleaning power to the fungi on resin parts and yet ensures excellent storage stability of a hypochlorite at a high temperature. The bleach cleaner composition is a liquid bleach cleaner composition containing (a) an alkali metal salt of hypochlorous acid, (b) a quaternary ammonium salt surfactant having a C8–10 long chain alkyl, (c) at least one selected from cumenesulfonic acid, xylenesulfonic acid, toluenesulfonic acid, and alkali metal salts thereof, (d) an alkali metal hydroxide and and water. It may further comprise (e) an amphoteric surfactant.

6 Claims, No Drawings

LIQUID BLEACH CLEANER COMPOSITION COMPRISING HYPOCHLOROUS ACID

FIELD OF THE INVENTION

The present invention relates to a liquid bleach cleaner composition.

PRIOR ART

Stains on hard surfaces in houses widely differ depending on the surfaces as objects to be cleaned. Generally, stains complexed by modified oils, dusts, etc. tend to adhere to kitchen ranges. In toilets and bathrooms, stains are insoluble salts themselves that are formed from inorganic substances and organic substances or, alternatively, stains are formed by bacteria or fungi that grow using these substances as bases. Among the stains on hard surfaces, particularly the blackish stains derived from these bacteria or fungi are difficult to remove sufficiently by a cleaner composed mainly of a surfactant and an abrasive material. For this reason, a chlorine-based bleach cleaner comprising a hypochlorite is used.

Japanese Patent Application Laid-Open (JP-A) No. 56-90897 describes a viscous-liquid, concentrated, chlorine-based bleach composition composed of an aqueous solution of hypochlorite containing a surfactant selected from a trialkylamine oxide, betaine, and a quaternary ammonium compound, a surfactant selected from a fatty acid salt, an acylsarcosinate salt, an alkyltauride salt, a sugar ester, and an alkylether sulfate, and a buffer agent. JP-A No. 57-61099 describes a liquid bactericidal bleach composition which contains a hypochlorite and a quaternary ammonium-type cationic surfactant and is excellent in bactericidal effect. Meanwhile, JP-A No. 7-82593 of the present inventors discloses a liquid bleach composition which contains a hypochlorite, a quaternary ammonium salt having a specific structural formula, and at least one selected from an alkylsulfate, an polyoxyethylene alkylether sulfate, an alkylbenzenesulfonate, and an amphoteric surfactant and is excellent in oily stain bleaching.

These liquid bleach cleaners are coated directly or sprayed on fungous stains by means of a manual sprayer. In view of the scattering problem at the time of spraying, JP-A No. 63-72798 and JP-A No. 63-165495 describe a method of inhibiting the scattering by forming foam at the time of spraying by the incorporation of a surfactant and a hydrotrope.

JP-A 1-153797 discloses a liquid bleach cleaner composition containing an alkali metal salt of hypochlorous acid,a quaternary ammonium salt having one long chain (C14–18) alkyl group, an arylsulfonate such as sodium xylenesulfonate and toluenesulfonic acid and an alkali metal hydroxide.

JP-A 2001-192700, published on Jul. 17th 2001, discloses a liquid bleach cleaner composition containing an alkali metal salt of hypochlorous acid, a quaternary ammonium salt and an alkali metal hydroxide.

JP-A10-204495discloses a liquid bleach cleaner composition containing hypochlorite, an alkali metal hydroxide, apolyoxyethylene alkylether sulfate,a fatty acid salt having a specified alkyl chain and at least one selected from cumenesulfonic acid, xylenesulfonic acid, toluenesulfonic acid and an alkali metal salt thereof.

Conventional chlorine-based bleach cleaners were satisfactorily effective to the stains on tiles or joints and to other blackish stains. In recent times, besides the stains on tiles or joints, there has been an increasing case where fungi grow on resin parts such as silicone resin-based caulkings used as joints between wall and bathtub, etc. or soft polyvinyl chloride-based packings, etc. This presents the problem that, even if conventional chlorine-based bleach cleaners exhibit satisfactory effects on tiles or joints, it is difficult to bleach and remove by decomposition the fungi on the above-mentioned resin parts by the conventional bleach cleaners.

The present inventors found that the bleaching effect is enhanced by the incorporation of a cationic surfactant into a system containing a hypochlorite because the contact of hypochlorite ions with a hydrophobic material becomes better. However, in a storability test at a high temperature, in particular at about 60° C., the stability of the composition incorporated with a cationic surfactant was found to be inferior in comparison with conventional fungi-removing compositions.

SUMMARY OF INVENTION

The object of the present invention is to provide a bleach cleaner composition which exhibits excellent bleach cleaning power to the fungi on resin parts and yet ensures excellent storage stability of a hypochlorite at a high temperature.

The invention provides a liquid bleach cleaner composition comprising 0.1 to 7.0% by mass of (a) an alkali metal salt of hypochlorous acid, 0.01 to 3.0% by mass of (b) a quaternary ammonium surfactant represented by the formula (1):

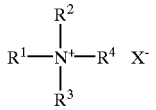

(1)

wherein $R^1$ is an alkyl group having 8 to 10 carbon atoms, alternatively an alkyl group having 8 or 10 carbon atoms;

$R^2$ and $R^3$ are each a methyl group or an ethyl group; and $R^4$ is a methyl group, an ethyl group or a benzyl group;

and $X^-$ is a halogen ion or $R^5SO_4$.$R^5$ representing an alkyl group having 1 to 5 carbon atoms.

0.1 to 3% by mass of (c) at least one selected from the group consisting of cumenesulfonic acid, xylenesulfonic acid, toluenesulfonic acid and alkali metal salts thereof, 0.2 to 3.0% by mass of (d) an alkali metal hydroxide and water.

The above shown composition may contain the balance of water.

The composition may further comprise (e) an amphoteric surfactant selected from the group consisting of an amine oxide surfactant having at least one alkyl group of 8 to 16 carbon atoms and a carboxybetaine surfactant having at least one alkyl group of 8 to 16 carbon atoms.

It may preferably comprise (f) a fatty acid of 6 to 14 carbon atoms or an alkali metal salt thereof.

It is preferable that the composition comprises 1 to 3% by mass of (a), 0.01 to 0.5% by mass of (b), 0.1 to 2% by mass of (c), 0.3 to 0.8% by mass of (d) and 0.05 to 1% by mass of (e). More preferable is the composition comprising (a) sodium hypochlorite, (b) octyldimethylbenzyl ammonium chloride, (c) sodium m-xylenesulfonate, (d) sodium hydroxide and (e) dimethyllauryl amineoxide.

The invention provides a bleach composition loaded into a spray container, wherein the bleach composition is the above shown composition.

DETAILED EXPLANATION OF INVENTION

Examples of the alkali metal salt of hypochlorous acid constituting the component (a) include sodium hypochlorite, potassium hypochlorite, etc. Sodium hypochlorite is particularly preferable. The content of the component (a) in the bleach cleaner composition for hard surface according to the present invention is in the range of 0.1 to 7.0% by mass, preferably in the range of 0.5 to 5.0% by mass, and more preferably in the range of 1.0 to 3.0% by mass. A sufficient bleaching power can be obtained if the content of the component (a) is 0.1% by mass or more, and a good stability can be obtained if the content of the component (a) is 7.0% by mass or less.

The component (b), that is, the quaternary ammonium-type surfactant represented by the formula (1), is intended for the enhancement of the bleach cleaning effect, which was not sufficiently provided by a conventional chlorine-based bleach cleaner, for bacterial or fungous stains on resins. This enhancement is obtained presumably because the quaternary ammonium-type surfactant improves the contact of hypochlorite ions with a hydrophobic material.

The present invention provides a liquid bleach cleaner composition which is effective to a resinous material. If the object resin is a vinyl chloride-based resin that is used as a packing material for window frames, etc., a compound, represented by the general formula (1) wherein $R^1$ has 8 carbon atoms, is most effective.

The content of the component (b) in the liquid bleach cleaner composition of the present invention is in the range of 0.01 to 3.0% by mass, preferably in the range of 0.01 to 1.0% by mass, and more preferably in the range of 0.01 to 0.5% by mass. The contents of the component (b) in these ranges lead to storage stability and effectiveness in the stain removal from resins.

The incorporation of the component (c) into the composition of the present invention makes it possible to enhance the storage stability at a high temperature. At the same time, the incorporation of the component (c) into the composition of the present invention further increases the foaming power at the time of spraying and further improves the adhesion to a hard surface when the composition is used. Among alkali metal salts intended for the component (c), sodium salts are preferable. Examples of the component (c) include sodium cumenesulfonate, sodium xylenesulfonate, sodium toluenesulfonate, etc. Among these salts, sodium m-xylenesulfonate is preferable.

The content of the component (c) in the bleach cleaner composition of the present invention is in the range of 0.1 to 3% by mass and particularly preferably in the range of 0.1 to 2% by mass. The contents of the component (c) in these ranges lead to the enhancement of storage stability of sodium hypochlorite at a high temperature and further increase of the foaming power at the time of spraying.

The alkali metal hydroxide constituting the component (d) indicates alkali metal ions in combination with hydroxy ions, i.e., free alkali, present in the liquid bleach cleaner composition, excluding a combination with other counter ions from being counted. For example, in the case where an organic acid is to be incorporated, even if an alkali metal hydroxide is incorporated, the alkali metal ion that becomes the counter ion of the organic acid is not counted as alkali metal hydroxide. Examples of the alkali metal hydroxide include sodium hydroxide, potassium hydroxide, etc. Sodium hydroxide is preferable. As a general trend, a large amount of an alkali metal hydroxide is incorporated into a chlorine-based bleaching agent, etc. in order to obtain the stability of hypochlorite. However, in the present invention, in order to obtain sufficient effect particularly on fungi-derived stains adhering to resins, the content of the component (d) in the composition is in the range of 0.2 to 3.0% by mass, preferably in the range of 0.2 to 1.0% by mass, and more preferably in the range of 0.3 to 0.8% by mass. A sufficient alkalinity can be obtained and the stability of the alkali metal salt of hypochlorous acid constituting the component (a) is good if the content of the component (d) is 0.2% by mass or more. Meanwhile, a proper bleaching rate and a sufficient effect on the fungi-derived stains on resins can be obtained in addition to the stability of the alkali metal salt of hypochlorous acid constituting the component (a) if the content of the component (d) is 3.0% by mass or less. Besides, in the present invention, the amount of the component (d) in the composition is measured in accordance with the method described in ASTM D 2022-89. That is, in accordance with this method, the amount of free alkali in the bleaching agent is measured as sodium hydroxide (NaOH). Also in the present invention, the amount of free alkali in the composition, which amount is obtained in accordance with this method, is taken as the amount of the component (d) in the composition.

In order to enhance the bleaching cleansability of the liquid bleach cleaner composition by improving its adhesion to the object surface such as wall without influencing the storage stability of the composition, it is preferable that the composition contains (e) an amphoteric surfactant selected from an amine oxide-type surfactant having at least one alkyl-group of 8 to 16 carbon atoms and a carboxybetaine-type surfactant having at least one alkyl group of 8 to 16 carbon atoms [this component is hereinafter referred to as component (e)] and further contains (f) a fatty acid of 6 to 12 carbon atoms or an alkali metal salt thereof [this component is hereinafter referred to as component (f)].

The amine oxide-type surfactant which has at least one alkyl group having 8 to 16 carbon atoms and constitutes the component (e) to be used in the present invention is preferably the one represented by the following general formula (2):

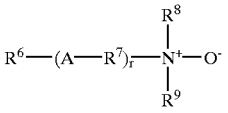

(2)

wherein $R^6$ is an alkyl group having 8 to 16 carbon atoms, preferably 10 to 16 carbon atoms, and particularly preferably 10 to 14 carbon atoms; $R^7$ is an alkylene group having 1 to 5 carbon atoms and particularly preferably 2 or 3 carbon atoms; $R^8$ and R9 are each an alkyl group or hydroxyalkyl group having 1 to 3 carbon atoms with the proviso that an alkyl group is preferable from the standpoint of storage stability; A is a group selected from —COO—, —CONH—, —OCO—, —NHCO—, and —O—; and r is a number of 0 or 1 with the proviso that r=0 is preferable from the standpoint of storage stability.

The carboxybetaine-type surfactant which has at least one alkyl group having 8 to 16 carbon atoms and constitutes the component (e) to be used in the present invention is preferably the one represented by the following general formula (3):

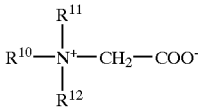

(3)

wherein $R^{10}$ is an alkyl group having 8 to 16 carbon atoms, preferably 10 to 16 carbon atoms, and particularly preferably 10 to 14 carbon atoms; and $R^{11}$ and $R^{12}$ are each an alkyl group having 1 to 3 carbon atoms.

The content of the amphoteric surfactant constituting the component (e) in the composition is preferably in the range of 0.05 to 3.0% by mass, more preferably in the range of 0.05 to 2.0% by mass, and particularly preferably in the range of 0.05 to 1.0% by mass. The contents of the component (e) in these ranges are desirable because the adhesion is improved as a result of enhancement of foamability without impairing the storage stability.

The component (f) of the present invention is a fatty acid having 6 to 14, preferably 8 to 12, carbon atoms or an alkali metal salt thereof. Excellent foamability can be exhibited if the number of carbon atoms falls in this range. Specifically, preferred examples thereof are caproic acid, caprylic acid, pelargonic acid, capric acid, undecanoic acid, lauric acid, tridecanoic acid, myristic acid, and sodium or potassium salts thereof. Fatty acids having a branched chain, such as isopelargonic acid, may also be used. Among these compounds, caprylic acid, capric acid, lauric acid, and sodium salts thereof are preferable.

The content of the component (f) in the composition of the present invention is preferably in the range of 0.05 to 3.0% by mass, more preferably in the range of 0.05 to 2.0% by mass, and particularly preferably in the range of 0.05 to 1.0% by mass. The contents of the component (f) in these ranges bring about excellent storage stability and foamability.

In the composition of the present invention, the ratios of the component (e)/the component (f) by mass are preferably 0.1 to 3.5, more preferably 0.2 to 1.5, because, if the ratios fall in these ranges, the storage stability becomes even better and adhesion is further improved as a result of enhancement of foamability.

In the present invention, although a surfactant other than the components (b), (e), and (f) may be used, it is desirable from the viewpoint of storage stability that the total of the content of such surfactant and the contents of the components (b), (e), and (f) is not more than 3.0% by mass, preferably not more than 2.0% by mass, and more preferably not more than 1.0% by mass. The surfactant that can be used in the present invention is preferably a surfactant which has an alkyl group having 6 to 22 carbon atoms. Specific examples thereof are one or more of anionic surfactants (excluding nitrogen-containing anionic surfactants such as amino acid derivatives, etc.) such as alkanesulfonates, alkylether sulfates, alkylbenzenesulfonates, alkylnaphthalenesulfonates, alkylsulfosuccinates, alkyldiphenyletherdisulfonates, alkylphosphates, polyoxyethylene alkyl ether sulfates, polyoxyethylene alkylarylether sulfates, and polyoxyethylene alkyl phenyl ether sulfonates; and amphoteric surfactants such as sulfobetaine other than the component (e). However, among the above-mentioned surfactants, anionic surfactants other than the components (e) and (f), alkylsulfonates and alkylsulfates in particular, are considered to combine electrically with cationic surfactants in the cleaner liquid and thus inhibit the synergism of the hypochlorite ion [component (a)] and the cationic surfactant [component (b)] in the present invention. For this reason, a tendency of the bleaching effect to decrease was observed. Accordingly, with respect to the incorporation of alkylsulfonates and alkylsulfates, the molar ratio of the cationic surfactant [component (b)]/(alkylsulfonates and/or alkylsulfates) in the composition, is preferably not less than 0.2, more preferably not less than 0.5, and particularly preferably not less than 1.

The liquid bleach cleaner composition of the present invention may contain a perfume component as an optional component. As to the examples of the perfume component that may be incorporated into a hypochlorite system, reference may be made to JP-A No. 50-74581 and JP-A No. 62-205200. The perfume component may consist of a single perfume or may be a mixture of perfumes. Normally, the content of the perfume in the composition is in the range of 0.001 to 0.5% by mass. But, the component and content of the perfume need to be carefully determined in order not to impair the storage stability.

The rest of the composition of the present invention is water, which, from the standpoint of stability, is preferably ion-exchanged water or distilled water prepared by removing metallic ions etc. present in small amounts. The water content is preferably 80 to 98%, more preferably 90 to 98%, in the composition from the standpoint of storage stability. Besides, from the standpoint of storage stability and bleaching effect, it is preferable to control the pH of the composition to a value in the range of 12.5 to 13.5 at 20° C.

From the standpoint of penetration into fungous stains, etc., the composition of the present invention preferably has a lower viscosity which is preferably in the range of 1 to 10 mPa·s, more preferably in the range of 1 to 6 mPa·s, at 20° C.

The methods for using the liquid bleach cleaner composition of the present invention are (1) a method in which the composition is sprayed directly on an object by use of a trigger-type sprayer, etc.; (2) a method in which an object is rubbed with a water-absorbent flexible material soaked with the composition; and (3) a method in which an object is immersed in a solution comprising the composition dissolved therein. Because of simplicity, the method (1) is advantageous. Accordingly, it is possible to obtain a bleaching agent loaded in a container, wherein the bleaching agent is the liquid bleach cleaner composition of the present invention. Preferable as the sprayer is a trigger-type sprayer capable of spraying as foam the liquid bleach cleaner composition composed of the components (a) to (f). The spraying weight is preferably in the range of 5 to 15 g per $m^2$ of the object.

EXAMPLES

Example 1

Liquid bleach cleaner compositions shown in Table 1 were prepared. In the table, % by mass indicates the concentration of each component in the composition. The pH value (at 20° C.) of each composition was in the range of 12.5 to 13.5. Sodium hypochlorite was used as an aqueous solution having a concentration of 13% by mass. These compositions were subjected to the evaluation of storage stability and bleaching power (effectiveness in bleaching removal of fungous stains) according to the methods described below. The results are shown in Table 1.

<Storage Stability>

The compositions were stored at 60° C. for 2 weeks. Upon completion of the storage, the storage stability of sodium hypochlorite was evaluated by the percentage of remaining effective chlorine. The percentage of remaining effective chlorine was obtained according to the equation given below. The ratings in evaluation were marked according to the following criteria based on the percentages of the remaining effective chlorine.

Percentage of remaining effective chlorine (%)= (concentration of effective chlorine in the composition after storage)/(concentration of effective chlorine in the composition before storage)×100

5; Percentage of remaining effective chlorine is 40% or more

4; Percentage of remaining effective chlorine is 30% or more but less than 40%

3; Percentage of remaining effective chlorine is 20% or more but less than 30%

2; Percentage of remaining effective chlorine is 10% or more but less than 20%

1; Percentage of remaining effective chlorine is less than 10%

<Evaluation of Fungi Removability>

Fungi were grown under an actual use condition on a soft polyvinyl chloride resin packing, which was used on a bathroom door adopted in an ordinary house, and a specimen was cut out of the packing. The specimen thus obtained was cut into test samples each having a size of about 1 cm for the evaluation. The value (L value) of each sample was measured using a color difference meter (ND-300A, manufactured by Nippon Denshoku Industries Co., Ltd.). The samples to be subjected to the evaluation were limited such that the difference in L values among the samples fell in the range of ±2. In the test, KIMWIPE, manufactured by Kimberley Clark Inc., was cut into sheets each having a size of 3 cm×3 cm, and a stack of two of the sheets was placed on the sample. Next, one droplet consisting of 500μL of the composition was caused to fall on the stack of the sheets and a state of wet contact was maintained for 15 minutes. After that, washing with water and natural drying were carried out. The evaluation was made in 10 grades according to the following criteria by visual inspection.

10; no blackish trace whatsoever remained

5; blackish trace slightly remained

0; colonies of fungi and stains partly remained

Table 1

TABLE 1

| | | | | Examples of formulation | | | | | | |
|---|---|---|---|---|---|---|---|---|---|---|
| | | | | 1 | 2 | 3 | 4 | 5 | 6 | 7 |
| Liquid bleach cleaner composition | composition (% by mass) | (a) | sodium hypochlorite | 2.5 | 2.5 | 2.5 | 2.5 | 2.5 | 2.5 | 2.5 |
| | | (b) | octyldimethylbenzylammonium chloride | 0.1 | | 0.3 | 0.3 | 0.3 | | |
| | | | octyltrimethylammonium chloride | | 0.2 | | | | | |
| | | | decyldimethylbenzylammonium chloride | | | | | | 0.3 | |
| | | | monoalkyl ($C_{12-14}$) dimethylbenzyl chloride | | | | | | | 0.3 |
| | | (c) | sodium metaxylenesulfonate | 0.5 | 0.5 | 0.5 | | 0.5 | 0.5 | 0.5 |
| | | | sodium cumenesulfonate | | | | 0.5 | | | |
| | | (d) | NaOH | 0.5 | 0.5 | 0.5 | 0.5 | 0.5 | 0.5 | 0.5 |
| | | (e) | dimethyllaurylamine oxide | 0.1 | 0.1 | 0.1 | 0.1 | | 0.2 | 0.2 |
| | | | dimethyllaurylammonium acetate(1) | | | 0.1 | 0.1 | | | |
| | | (f) | caprylic acid | 0.25 | 0.25 | 0.25 | 0.25 | | 0.25 | 0.25 |
| | | others | sodium polyxyethylene lauryl sulfate(2) | | | | | | | |
| | | | perfume component | 0.05 | 0.05 | 0.05 | 0.05 | 0.05 | 0.05 | 0.05 |
| | | | ion-exchanged water | balance | balance | balance | balance | balance | balance | balance |
| | | | Total | 100 | 100 | 100 | 100 | 100 | 100 | 100 |
| | | | pH (20° C.) | 12.9 | 12.9 | 12.9 | 12.9 | 12.9 | 12.9 | 12.9 |
| | | | strange stability | 5 | 5 | 5 | 5 | 5 | 5 | 4 |
| | | | bleaching power | 9 | 9 | 10 | 10 | 10 | 9 | 10 |

| | | | | Examples of formulation | | | | | |
|---|---|---|---|---|---|---|---|---|---|
| | | | | 8 | 9 | 10 | 11 | 12 | 13 |
| Liquid bleach cleaner composition | composition (% by mass) | (a) | sodium hypochlorite | 2.5 | 2.5 | 2.5 | 2.5 | 2.5 | 2.5 |
| | | (b) | octyldimethylbenzylammonium chloride | 0.1 | | | | | |
| | | | octyltrimethylammonium chloride | | 0.1 | | | | |
| | | | decyldimethylbenzylammonium chloride | | | | | | |
| | | | monoalkyl ($C_{12-14}$) dimethylbenzyl chloride | | 0.2 | 0.3 | | | |
| | | (c) | sodium metaxylenesulfonate | | | 0.5 | | 0.5 | 0.5 |
| | | | sodium cumenesulfonate | | | | 0.5 | | |
| | | (d) | NaOH | 0.5 | 0.5 | 0.15 | 0.5 | 0.5 | 0.5 |
| | | (e) | dimethyllaurylamine oxide | 0.1 | 0.2 | 0.2 | 0.2 | | |
| | | | dimethyllaurylammonium acetate(1) | | | | | 0.2 | |
| | | (f) | caprylic acid | 0.25 | 0.25 | 0.25 | 0.25 | 0.25 | 0.25 |
| | | others | sodium polyxyethylene lauryl sulfate(2) | | | | | | 0.6 |
| | | | perfume component | 0.05 | 0.05 | 0.05 | 0.05 | 0.05 | 0.05 |
| | | | ion-exchanged water | balance | balance | balance | balance | balance | balance |
| | | | Total | 100 | 100 | 100 | 100 | 100 | 100 |
| | | | pH (20° C.) | 12.9 | 12.9 | 12.6 | 12.9 | 12.9 | 12.9 |
| | | | strange stability | 3 | 2 | 1 | 5 | 5 | 3 |
| | | | bleaching power | 9 | 9 | 10 | 4 | 4 | 4 |

(1) dimethyllaurylammonium acetate: represented by the general formula (3) wherein $R^{10}$ is a lauryl group and $R^{11}$ and $R^{12}$ are each a methyl group (2) sodium polyoxyethylene lauryl ether sulfate: sodium salt of polyoxyethylene lauryl ether sulfuric ester (average number of moles of ethylene oxide added: 3.0)

Example 2

400 mL of the composition according to the formulation example 3 and 400 mL of the composition according to the formulation example 5 were each prepared according to Table 1. These compositions were separately loaded into a commercially available container with a trigger [fungi-removing HEIGHTER (manufactured by Kao Corporation)]. By using these containers, the compositions were each sprayed on the fungi present on tile joints in a bathroom and the bleaching power of each composition was visually inspected. As a result, the bleaching performance of the composition according to the formulation example 3 was distinctly better than that of the composition according to the formulation example 5.

What is claimed is:

1. A liquid bleach cleaner composition comprising 0.1 to 7.0% by mass of (a) an alkali metal salt of hypochlorous acid, 0.01 to 3.0% by mass of (b) a quaternary ammonium surfactant represented by the formula (1):

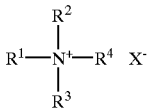

(1)

wherein $R^1$ is an alkyl group having 8 to 10 carbon atoms;

$R^2$ and $R^3$ are each a methyl group or an ethyl group; and $R^4$ is a methyl group, an ethyl group or a benzyl group;

and $X^-$ is a halogen ion or $R^5SO_4$.$R^5$ representing an alkyl group having 1 to 5 carbon atoms, 0.1 to 3% by mass of (c) at least one selected from the group consisting of cumenesulfonic acid, xylenesulfonic acid, toluenesulfonic acid and alkali metal salts thereof, 0.2 to 3.0% by mass of (d) an alkali metal hydroxide and water.

2. The liquid bleach cleaner composition according to claim 1 further comprising (e) an amphoteric surfactant selected from the group consisting of an amine oxide surfactant having at least one alkyl group of 8 to 16 carbon atoms and a carboxybetaine surfactant having at least one alkyl group of 8 to 16 carbon atoms.

3. The liquid bleach cleaner composition according to claim 1 or 2 further comprising (f) a fatty acid of 6 to 14 carbon atoms or an alkali metal salt thereof.

4. A bleach composition loaded into a spray container, wherein the bleach composition is the liquid bleach cleaner composition according to claim 1.

5. The liquid bleach cleaner composition according to claim 2, which comprises 1 to 3 % by mass of (a), 0.01 to 0.5 % by mass of (b), 0.1 to 2% by mass of (c), 0.3 to 0.8 % by mass of (d) and 0.05 to 1% by mass of (e).

6. The liquid bleach cleaner composition according to claim 2, or 5, which comprises (a) sodium hypochlorite, (b) octyldimethylbenzyl ammonium chloride, (c) sodium m-ylensulfonate, (d) sodium hydroxide and (e) dimethyllauryl amineoxide.

* * * * *